United States Patent [19]

Welsh et al.

[11] 3,992,598

[45] Nov. 16, 1976

[54] AIRFLOW VELOCITY SWITCH

[75] Inventors: Richard Francis Welsh, Fremont; Philip James Beer, Mountain View; Quinten La Marr Hazleton, San Jose, all of Calif.

[73] Assignee: Afton Incorporated, Palo Alto, Calif.

[22] Filed: Dec. 4, 1974

[21] Appl. No.: 529,374

[52] U.S. Cl. ..... 200/81.9 M; 200/85 R

[51] Int. Cl.[2] ..... H01H 35/40

[58] Field of Search ..... 200/81.9 R, 81.9 M, 200/85 R; 116/70, 117 R, 117 A; 73/228; 340/239 R, 240, 241; 335/205

[56] References Cited

UNITED STATES PATENTS

| | | | |
|---|---|---|---|
| 2,600,309 | 6/1952 | MacDonald | 200/81.9 M |
| 2,843,693 | 7/1958 | Scriver | 200/85 R |
| 3,260,820 | 7/1966 | O'Brien, Jr. | 200/81.9 M |

FOREIGN PATENTS OR APPLICATIONS

| | | | |
|---|---|---|---|
| 741,484 | 12/1955 | United Kingdom | 200/81.9 M |

OTHER PUBLICATIONS

Airflow Switch, Williams, IBM Tech. Discl. Bulletin, vol. 13, No. 6, Nov. 1970, p. 1680.

*Primary Examiner*—Gerald P. Tolin
*Attorney, Agent, or Firm*—Flehr, Hohbach, Test, Albritton & Herbert

[57] ABSTRACT

A switch assembly for sensing velocity of airflow along an airflow path and having a vane for disposition in the airflow. The vane is pivoted in a case of framework and rotational movement of the vane about the pivot axis actuates a magnetic reed switch mounted within the framework. A variety of weights are provided for attachment to the side of the vane opposite the side upon which the airflow impinges for providing a variety of unbalance torques to the vane which are counter to torque produced by airflow impingement. A consequent variety of airflow velocity switching points may be obtained. For airflow paths which are small in cross section, the pivot axis of the vane may extend parallel to the cross section and the angle through which the vane may move approaches 80° from the plane of the cross section so that a minimal surface of the vane will oppose airflow through the path.

5 Claims, 6 Drawing Figures

AIRFLOW VELOCITY SWITCH

BACKGROUND OF THE INVENTION

This invention relates to an airflow velocity vane actuated switch, and more particularly to such an airflow velocity switch for use in sensing cooling fluid flow in cooling systems.

In applications where cooling is required for equipment subject to thermal destruction, thermostats have often been used at the location of the equipment to be cooled. Thermostats may sense the temperature of the cooled equipment, but often only provide an indication after the destructive temperature has been reached. A cooling system using thermostatic sensors will not provide early detection of failure of the prime mover of the coolant fluid. If a fan, for example, in an air cooling system becomes inoperable, early warning of the failure would prevent destruction of the temperature sensitive equipment.

A device for sensing when a cooling fan motor is inoperable also provides only limited protection against thermal destruction. There are generally air filters upstream from the fan for cleansing the cooling airflow. The filters may become clogged by contaminants removed from the airflow, thus blocking cooling airflow from the equipment to be cooled.

A need therefore exists for means to sense the flow of the cooling fluid so that the temperature sensitive equipment may be shut down prior to thermal destruction in the event such flow stops. Prior art means for sensing coolant flow has utilized microswitches actuated by lever arms having attached vanes of varying area for disposition in the fluid flow. Larger vane areas were required for lower coolant flow velocities, and smaller vane areas were acceptable for higher coolant velocities. The prior art vane switches therefore require a multiplicity of vanes having considerable dimensions for monitoring a multiplicity of coolant velocities. There is therefore a need for a device which will monitor coolant velocities near the source for coolant motion, and which may be adjusted readily to monitor a variety of such velocities without altering the dimensions of the vane in the airflow.

SUMMARY AND OBJECTS OF THE INVENTION

A switch is disclosed herein which senses the velocity of flow of a fluid in an upward direction along a flow path by disposing a vane horizontally in the flow path. The vane is pivotally mounted in rotational movement relative to a framework which also has mounted therein a switch actuated by a predetermined angle of rotational movement of the vane. A weight for providing an unbalance torque in the vane in opposition to the torque induced by impact of the fluid on the surface of the vane is attached to the vane. By a proper selection of the weight providing the unbalance torque, the switch may be calibrated for actuation at a predetermined fluid flow velocity.

In general, it is an object of the present invention to provide a fluid flow velocity switch which is capable of indicating one of a plurality of flow velocities without variation of physical size.

Another object of the present invention is to provide a fluid flow velocity switch of the above character which may be used in a restricted cross section coolant flow path.

Another object of the present invention is to provide a fluid flow velocity switch of the above character which is unaffected by dust and humidity.

Another object of the present invention is to provide a fluid flow velocity switch of the above character having a vane which is free from errors induced by mechanical instability such as vane resonance or vane unduced airflow aberrations.

Additional objects and features of the invention will appear from the following description in which the preferred embodiments have been set forth in detail in conjunction with the accompanying drawings.

DESCRIPTION OF THE PREFERRED EMBODIMENTS

The disclosed invention provides an indication that a fluid flow velocity either exceeds or is less than a predetermined value. The invention is insensitive to pressure. The indication is in the form of a switch actuation. The switch actuation may be a switch closure or a switch opening as desired. The switch actuation may be used to provide visual indication of the switch state or to shut down equipment which might thereafter be subject to thermal destruction from self-generated heat if allowed to continue to operate.

Figure 1:
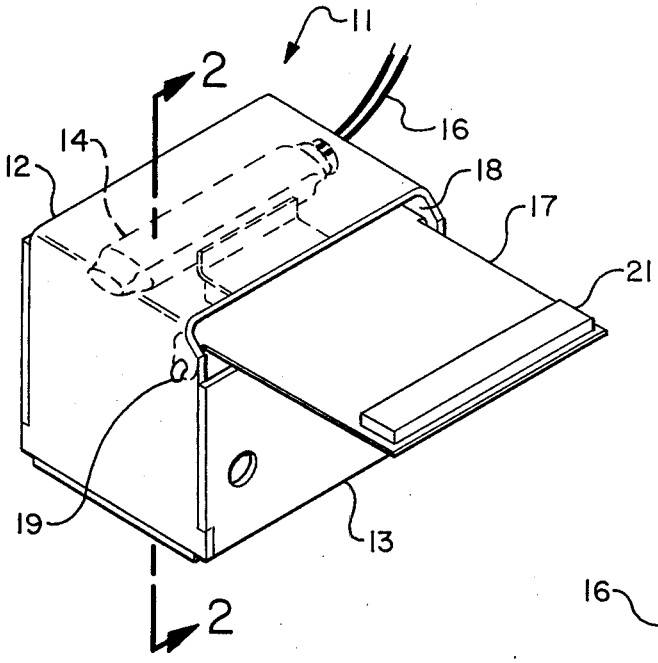
FIG. 1 is an isometric view of one embodiment of the fluid flow switch.

FIG. 1 is an isometric view of one embodiment of a fluid flow switch 11 which may be utilized in a liquid flow or a gas flow as desired. The ensuing description will describe the fluid flow switch 11 as an airflow switch for use in an air cooling system. The description could as well be applied to a system using other gases as a coolant or to a liquid flow cooling system where coolant flow monitoring is desired.

Fluid flow switch 11 has an outer case having an upper U-shaped half 12 and a lower U-shaped half 13. Upper case half 12 in this embodiment serves as a framework upon which is mounted a magnetic switch 14. Switch 14 may be securely fastened to the inside of upper case half 12 by means of an epoxy cement. Magnetic switch 14 is of the dry reed switch type currently available, covered with plastic shrink tubing, such as PVC 105. Electrical leads 16 are shown connected to magnetic switch 14. In a preferred embodiment leads 16 are of 24 gauge wire.

A vane 17 is shown extending from an aperture 18 between upper and lower case halves 12 and 13 respectively. Vane 17 is pivotally mounted within upper case half 12 by means of a pivot pin 19 which extends through the sidewalls of upper case half 12. A weight 21 is positioned on the outer edge of vane 17 for producing an unbalance torque about pivot pin 19.

Figure 2:
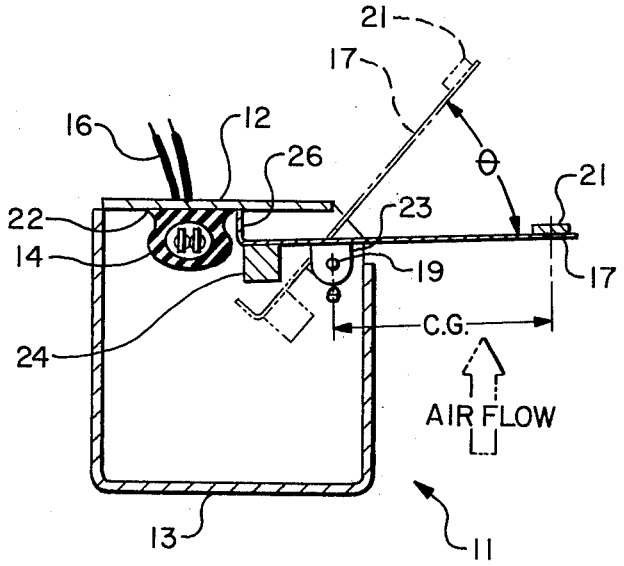
FIG. 2 is a sectional view along the line 2—2 of FIG. 1.

Referring to FIG. 2, magnetic switch 14 is shown secured by an epoxy fillet 22 to the underside of upper case half 12. Vane 17 is shown in its "at rest" position having a pair of depending members 23 having holes therein through which pivot pin 19 extends. Vane 17 also has secured thereto, on the underside adjacent to switch 14, a magnet 24. An upwardly extending member 26 is shown on vane 17 for contacting the underside of upper case half 12, thereby operating as a stop for motion of vane 17 due to clockwise torques generated by weight 21 as seen in FIG. 2.

FIG. 2 shows switch 14 as a magnetic reed switch together with magnet 24 for actuating reed switch 14 to the closed position in the "at rest" or horizontal position as shown. Vane 17 may be moved rotationally about pivot pin 19 through an angle $\theta$ as indicated. The position of the vane 17 in the presence of an airflow sufficient to displace vane 17 with weight 21 applied through the angle $\theta$ is shown in phantom lines. In this position magnet 24 is removed from the vicinity of magnetic switch 14 sufficiently to allow magnetic switch 14 to open.

Figure 3:
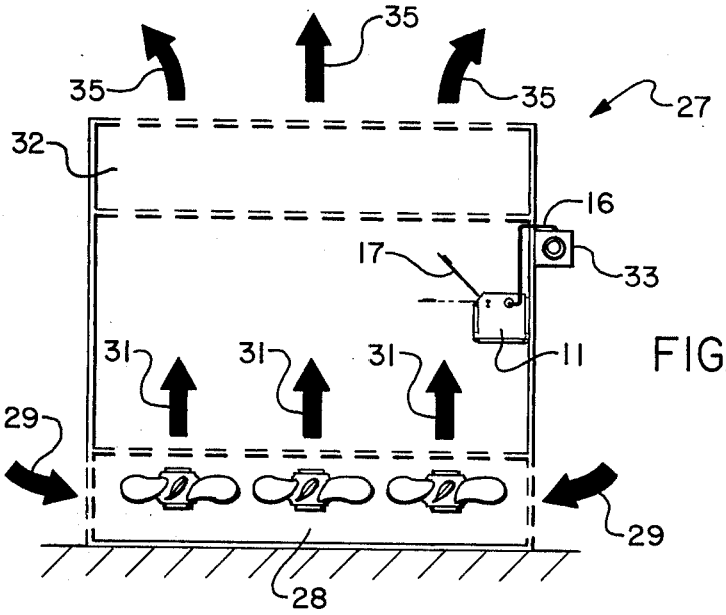
FIG. 3 is a sectional view of one application for the fluid flow switch of FIG. 1.

Turning now to FIG. 3, a cabinet 27 is shown having a standard array of fans 28 positioned in the bottom thereof. As seen in FIG. 3, air is urged by the array of fans 28 to enter into the bottom of cabinet 27 and to flow upwardly therethrough as indicated by arrows 31. Airflow switch 11 is shown mounted on the side of cabinet 27 internally with vane 17 disposed in the airflow represented by arrows 31. Equipment 32 for air cooling is shown positioned in the upper portion of cabinet 27. Equipment 32 is of the type which requires cooling by the passage of coolant fluid due to internal generation of heat which would reach a destructive level if not removed by the coolant. The coolant, air in this instance, is shown being exhausted from the top of cabinet 27 at arrows 35. Leads 16 are shown extending from fluid flow switch 11 to an indicator 33 for providing indication of insufficient airflow at arrows 31 for whatever reason. It is to be understood that flow switch 11 could be utilized to interrupt power to equipment 32 for shutdown of equipment 32 in the event that airflow as indicated by arrows 31 is reduced to a velocity below that deemed necessary for proper cooling of equipment 32.

Figure 4:
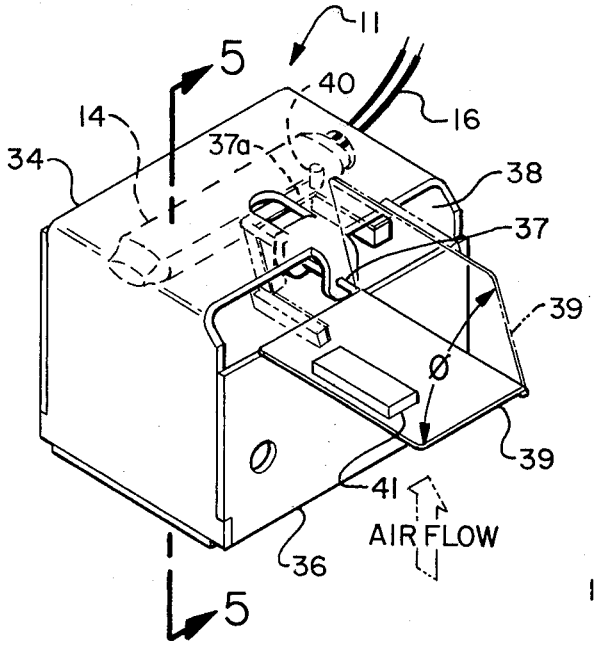
FIG. 4 is an isometric view of another embodiment of the fluid flow switch.

Referring to FIG. 4 another embodiment of the fluid flow switch 11 is shown. An upper case half 34 is combined with a lower case half 36 as in FIG. 1 above, to form a framework for the fluid velocity switch 11. A pivot pin 37 extends from an opening 38 between upper and lower case halves 34 and 36 respectively, upon which is mounted a vane 39. Vane 39 has mounted thereupon a weight 41 for a purpose similar to that described for weight 21 above. Fluid velocity switch 11 of FIG. 4 also has magnetic switch 14 mounted therein with electrical leads 16 attached thereto. Magnet 24 is shown attached to a lateral extension 37*a* on pivot pin 37. An upwardly extending member 40 is shown on lateral extension 37*a* for contacting the underside of upper case half 34, thereby operating as a stop for motion of vane 39 due to counter clockwise torques generated by weight 41 as seen in FIG. 4.

Figure 5:
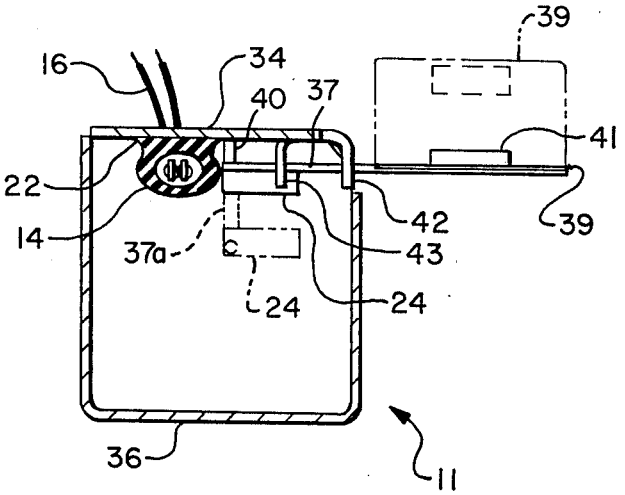
FIG. 5 is a sectional view along the line 5—5 of FIG. 4.

FIG. 5 shows the manner in which pivot pin 37 is supported within upper case half 34. Depending members 42 and 43 are attached to upper case half 34 having holes therethrough for accepting pivot pin 37. Vane 39 is shown "at rest" in solid lines in FIGS. 4 and 5. In this position, magnet 24 is adjacent magnetic switch 14 so as to cause closure of switch 14. Upon the application of an airflow as indicated in FIG. 4 sufficient to overcome the torque induced about the axis of pivot pin 37 by weight 41, magnet 24 will assume the position shown by phantom lines as vane 39 assumes a commensurate position also shown by phantom lines. In this position of magnet 24 magnetic switch 14 opens.

In what may amount to 90% of current applications, the embodiment of FIG. 1 is utilized. The embodiment of FIG. 4 may be quite useful in the remaining 10% of applications which are depicted generally in FIG. 6. An airflow path 44 of restricted cross section is shown in which flow of air, or any coolant, is directed upon a component 46 which may have internal heat generation characteristics. In such an instance cooling airflow is most efficiently achieved by drawing air as indicated by arrows 47 into the bottom of restricted path 44 by means of a fan 48 or equivalent. Airflow proceeds upwardly as indicated by arrow 49 through restricted flow path 44 impinging upon vane 39. When the velocity of airflow 49 reaches a value sufficient to counteract a torque about pivot pin 37 induced by weight 41, magnet 24 will be displaced rotationally through an angle $\phi$ so as to remove its influence from magnetic switch 14. In this embodiment vane 39 is designed to rotate clockwise as seen in FIG. 4 through an angle $\phi$ ranging from 75° to 85° from the "at rest" position. The rotation of vane 39 is induced by the influence of the airflow 49 impinging on the up stream side of vane 39. It should be noted that both in the embodiment of FIG. 4 and FIG. 1, weights 41 and 21 respectively are placed on the downstream side relative to the airflow so that they will not disrupt the airflow thereby causing mechanical position instability in the vanes 39 and 17 respectively due to topographically induced airflow aberrations.

With vane 39 elevated approximately 75° or more from the horizontal by the airflow represented by arrow 49, it may be seen that only 25% of the side area of vane 39 is presented to the restricted airflow path 44 for impeding the flow of air therethrough. This embodiment therefore serves those applications where additional flow impedance contributed by a coolant velocity sensor must be kept to a minimum.

As described above the actuation of switch 14 may be directed to an indicator 33 through electrical leads 16. As also described above the actuation of switch 14 may be directed to the power control for component 46 to remove the power therefrom in the event the airflow through restricted cross section path 44 falls below that velocity determined as sufficient for providing cooling for component 46.

Figure 6:
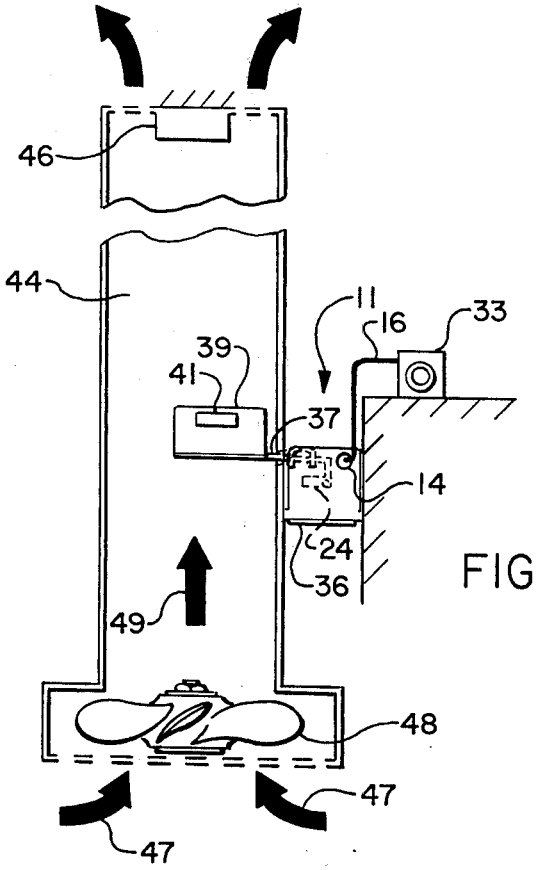
FIG. 6 is a sectional view of one application for the fluid flow switch of FIG. 4.

As a general rule fluid flow switch 11 is mounted relatively close to the device for causing coolant flow such as fan array 28 in FIG. 3 or fan 48 in FIG. 6. Fluid filters may exist in the system in series with the coolant fans and the component or equipment to be cooled. In this fashion coolant velocity actually delivered through the system to the equipment or component may be monitored. A blocked series filter will reduce coolant flow which will be sensed by switch 11 when flow decreases below the predetermined level. When gas or air cooling is utilized the coolant direction is generally upward as an efficiency measure, since hot gases tend to rise. Therefore FIGS. 3 and 6 have been shown with the coolant represented by arrows 31 and 49 respectively oriented in an upward direction.

Table I below shows the velocity of air in the embodiment of FIG. 3 for opening and closing of switch 14 with varying weights 21 applied to vane 17. One-sixteenth inch thick lead sheet was used in this embodiment with the width and lever arms to the CG as indicated. As a consequence the torques T about pivot axis 19 in gram centimeters were obtained.

TABLE I

| $V_{OPEN}$ FT/MIN | $V_{CLOSE}$ FT/MIN | T gm cm | width* cm | C.G.** cm | weight gms |
|---|---|---|---|---|---|
| 720 | 640 | 0 | 0 | — | — |
| 1100 | 1030 | 0.98768 | 0.055 | 2.8335 | 0.348 |
| 1350 | 1280 | 1.86240 | 0.105 | 2.810 | 0.665 |
| 1550 | 1480 | 2.6907 | 0.154 | 2.786 | 0.975 |
| 1800 | 1720 | 3.88675 | 0.226 | 2.720 | 1.43 |
| 2100 | 2020 | 5.5576 | 0.330 | 2.661 | 2.088 |
| 2400 | 2310 | 7.48559 | 0.45 | 2.628 | 2.848 |
| 2700 | 2600 | 9.6705 | 0.598 | 2.555 | 3.785 |
| 4000 | 3870 | 22.1094 | 1.76 | 1.983 | 11.141 |

*width of lead sheet having cross section of 0.1591 cm × 2.937 cm (1/16" × 1.154") = 0.4672 cm². Density of lead = 13.55gm/cm³.
**distance of lead center of gravity from fulcrum of switch vane.

Table I includes velocities which are in practical usage. Velocities below a minimum value do not provide sufficient cooling for most components requiring cooling. Velocities above the maximum value in Table I generate audible nuisance which requires alternate cooling means.

It should be noted that the vane size in the disclosed embodiments is constant. The torque opposing the force resulting from impingment of the airflow upon the vane surface is provided by the weights 21 and 41. These weights are the adjustable quantity in the disclosed invention. Vane size is not changed. A variety of sensed coolant velocities are obtained by a variety of weights 21 and 41 applied to vanes 17 and 39 respectively. It is therefore an adjustment of opposing torque about pivot axes 19 and 37 which provides for the capability of switching at a variety of coolant velocities. The fact that the opposing torques in the embodiments described are obtained by weights 21 and 41 is not meant to be a restriction on the inventive concept disclosed and claimed. Adjustable torque torsion springs may be mounted on the pivot axes 19 and 37 for example. In more sophisticated applications torque counter to that produced by air flow may be electrically induced by a pivot axis mounted torque motor.

It should further be noted that the size of the case provided by upper and lower case halves 12 and 13 or 34 and 36 is sufficient to maintain adequate distance between magnet 24 and any mounting surfaces which may be magnetic to obviate any errors induced by magnetic attraction therebetween.

Magnetic switch 14 may be replaced by any one of a number of mechanical switches or solid state switches which may have low power on and off switching capability. The magnetic switch 14 has been used for the description of the preferred embodiments herein as a convenience only and the invention is not restricted to the use of magnetic switches only.

A liquid coolant velocity switch has been disclosed which may be readily used in restricted coolant flow path cross sections and which uses a constant vane area for a variety of velocity sensing points.

I claim:

1. A switch sensing the flow velocity of a fluid along a vertical flow path in an upward direction comprising a vane having an upper downstream side and an upstream side exposed to the fluid flow, means for retaining said vane in horizontal disposition in the vertical flow path in the absence of flow of the fluid, means for mounting said vane for pivotal motion about a transverse axis so that the fluid flow urges said vane rotationally thereabout, a framework supporting said means for mounting, a magnetically actuated switch disposed on said framework, a magnet mounted on said vane for rotational movement therewith in and out of a position adjacent to said magnetically actuated switch, whereby said switch is actuated by a predetermined angle of rotational movement of said vane, and a predetermined mass fixedly attached to said downstream side of said vane spaced from said transverse axis, whereby airflow disruption by said predetermined mass is minimized and a predetermined torque is applied to said vane, said predetermined torque having a sense counter to that of the torque produced by the flow velocity of the fluid, the torque caused by fluid impinging against said vane at a predetermined fluid flow velocity along the flow path being greater than said predetermined torque thereby rotating said vane through said predetermined angle.

2. A switch as in claim 1 wherein said vane has a fixed area surface on said upstream side, together with an additional weight operating to alter said predetermined torque, whereby the fluid flow velocity sensed by said switch is altered.

3. A switch an in claim 1 wherein the flow path is restricted in cross section, and said predetermined angle of rotational movement of said vane is greater than 75°, whereby substantially 75% of said vane side area is removed from the fluid flow path cross section, thereby minimizing flow impedance induced by said vane.

4. A gas flow switch indicating a predetermined gas flow velocity in one direction along an upward vertical gas flow path, comprising a framework positioned in juxtaposition with the gas flow path, pivot means mounted in said framework defining a pivot axis relative thereto, a magnetically actuated switch mounted on said framework, a vane mounted on said pivot means having opposing broad surfaces for disposition in the gas flow path, said broad surfaces being disposed on one side of said pivot axis, a magnet mounted on said vane on the other side of said pivot axis, so that said magnet moves angularly with said broad surfaces into and out of a position adjacent to said magnetically actuated switch, a weight fixedly mounted on one of said broad surfaces spaced from said pivot axis for producing a first torque for urging said vane to rotate about said pivot against the direction of the gas flow, and means for stopping said first torque from producing rotation of said vane when said broad surfaces are disposed in a substantially horizontal orientation and there is no gas flow, so that when the predetermined gas flow velocity is directed against one of said broad surfaces a second torque is produced which is greater than and counter to said first torque, whereby said magnetically actuated switch is operated by the torque derived from the predetermined gas flow velocity.

5. A gas flow switch as in claim 4 wherein the gas flow path is restricted in cross section and said pivot means is disposed so that said pivot axis lies in the cross section, said pivotal motion exceeding 75°, whereby said vane presents less than 25% of said broad surface to the gas flow path cross section.

* * * * *